US005720207A

United States Patent [19]

Milner et al.

[11] Patent Number: 5,720,207

[45] Date of Patent: Feb. 24, 1998

[54] SOCKET LOCKING EXTENSION FOR WRENCH HANDLE

[76] Inventors: W. Ross Milner, P.O. Box 30726, Albuquerque, N. Mex. 87190; Brian E. Tyree, 4921 Royene NE., Albuquerque, N. Mex. 87110

[21] Appl. No.: 747,455

[22] Filed: Nov. 12, 1996

[51] Int. Cl.[6] ..... B25B 23/16

[52] U.S. Cl. ..... 81/177.85; 81/177.2

[58] Field of Search ..... 87/177.1, 177.2, 87/177.85; 403/361, 326, 321

[56] References Cited

U.S. PATENT DOCUMENTS

| | | | |
|---|---|---|---|
| 3,924,493 | 12/1975 | Penner | 81/177 G |
| 4,399,722 | 8/1983 | Sardo, Jr. | 81/60 |
| 4,400,511 | 8/1983 | Nickipuck | 81/177 G |
| 4,502,365 | 3/1985 | Hacker | 81/177 G |
| 4,537,100 | 8/1985 | Palm | 81/177.85 |
| 4,571,113 | 2/1986 | Coren | 403/322 |
| 4,589,308 | 5/1986 | Palm | 81/177.85 |
| 4,733,584 | 3/1988 | Karge | 81/177.85 |
| 4,768,405 | 9/1988 | Nickipuck | 81/177.85 |
| 4,770,073 | 9/1988 | Palm | 81/177.85 |
| 4,781,085 | 11/1988 | Fox | 81/177.85 |
| 4,817,476 | 4/1989 | Karge | 81/177.85 |
| 4,848,196 | 7/1989 | Roberts | 81/177.85 |
| 4,865,485 | 9/1989 | Finnefrock, Sr. | 403/325 |
| 4,938,107 | 7/1990 | Nickipuck | 81/177.85 |
| 4,962,682 | 10/1990 | Rose et al. | 81/177.85 |
| 5,214,986 | 6/1993 | Roberts | 81/177.85 |
| 5,289,745 | 3/1994 | Beardsley | 81/177.2 |

*Primary Examiner*—James G. Smith

[57] ABSTRACT

A socket locking extension element includes a latching mechanism for automatically locking a socket to the driven end simultaneously on application of a wrench drive element to the drive end of the extension. The extension main shaft has a continuous void communicating with the drive end and the socket end of the extension. A captive latch lug projecting through a portion of the socket engagement surfaces is constantly forced into mating recesses in the socket by the outward reaction of a longitudinal operating rod in the continuous void and always bent in flexure by the latch lug. When a socket is snap-fitted to the driven end of the extension, this reaction holds but does not lock the socket in place, permitting it to be changed as desired. When wrench driving element is engaged in the drive end of the extension, the rod translates and an inclined surface on the rod locks the socket against the latch lug and the opposite side of the continuous void. The socket is non-removably retained until the wrench driving element is disengaged. The outward reaction of the rod against the latch lug generates all the force required to merely latch or to positively lock the socket to the extension. When the wrench drive element is removed, the longitudinal component of the outward reaction generated by the rod end incline shifts the rod back to the socket latched but not locked position.

2 Claims, 1 Drawing Sheet

SOCKET RETAINED AND LOCKED

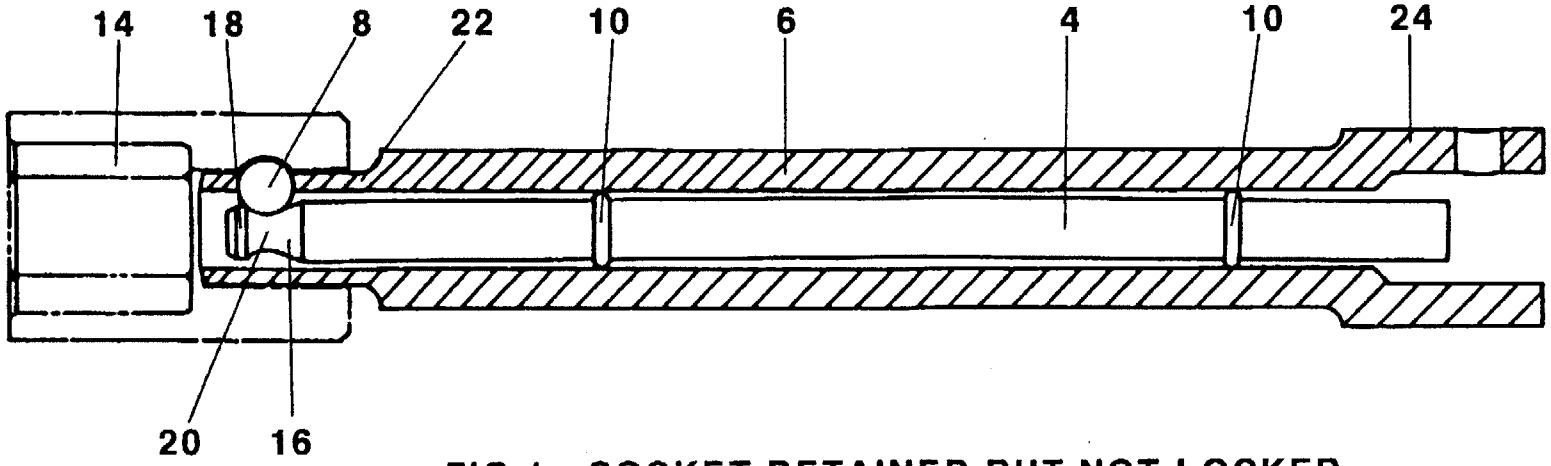
FIG.1 - SOCKET RETAINED BUT NOT LOCKED
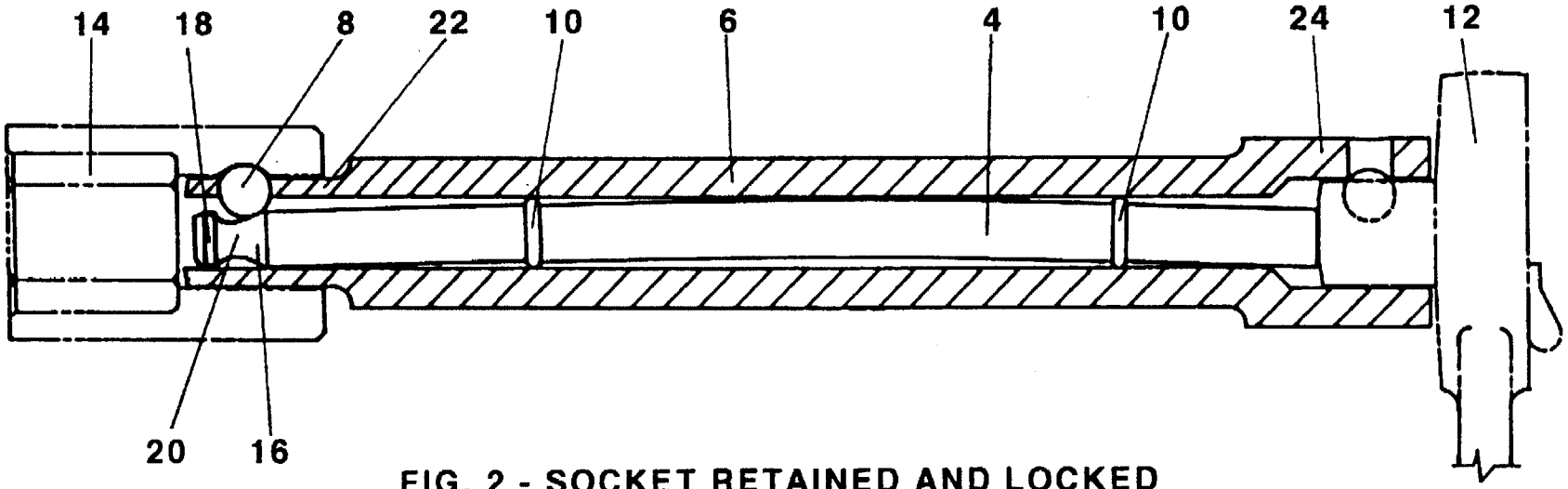
FIG. 2 - SOCKET RETAINED AND LOCKED

SOCKET LOCKING EXTENSION FOR WRENCH HANDLE

BACKGROUND—FIELD OF THE INVENTION

This invention relates generally to tools and more particularly, to an improved extension member for use with a wrench handle and socket and wherein the extension member includes a locking mechanism to prevent unwanted separation of a socket from the extension member.

BACKGROUND OF THE INVENTION

No doubt one of the most frequently used tools of a mechanic, especially in the fields of automotive, aircraft, and equipment repair and assembly, is the socket wrench. This tool comprises a wrench of any one of various types having a square, polygonal, or splined drive element adapted to engage in a snap-fit manner, a matching joint as formed in or on any one of various sizes of socket wrenches, the latter designed to captively engage the multi-sided periphery, external or internal, of either a nut or the head of a bolt. When servicing pieces of equipment of any size, whether office machines or heavy construction machinery, the need frequently arises to apply or remove threaded fasteners which are not readily accessible in the crowded quarters often immediately surrounding the fastener. In these cases, one applies an extension element between the turning wrench handle and socket. This extension is composed of an elongated element having a drive end engaged by the wrench handle drive element which is snap fitted to the drive end. The extension will then transmit the turning torque to the driven end to turn the socket engaging the nut or bolt head.

A problem encountered when using many existing extensions with socket tool sets is that often when withdrawing the tool assembly from an in-use position, the socket is pulled from the driven end of the extension element due to friction with the involved nut or bolt head. Thereafter, the socket may fall to an even more inaccessible location or perhaps remain attached to the nut or bolt which is already in a tightly restricted position. This can cause damage to equipment or harm to the operator. Thus, it is highly desirable to have an extension which will automatically provide a positive locking action to retain sockets on its driven end.

DESCRIPTION OF THE PRIOR ART

Numerous lock/release devices for socket tools have been developed, with many specifically for use with socket tool extensions. Room remains for improvements in this area. Some prior designs have proven far too costly to produce because of complexity of components. Others have fallen short of providing a reliably positive locking action.

The lack of needed improvements in the prior art is illustrated in the following cited U.S. Pat. No. 3,924,493-Dec. 9,1975 to Penner; U.S. Pat. No. 4,817,476-Apr. 4, 1989 to Karge; U.S. Pat. No. 4,781,085-Nov. 1, 1988 to Fox; U.S. Pat. No. 4,865,485-Sep. 12, 1989 to Finnefrock; and U.S. Pat. No. 4,962,682-Oct. 16, 1990 to Rose & Park. These patents have in common external control buttons near the driven end of the extension which could easily be accidentally depressed, releasing the socket unintentionally. They also have a number of small parts and require unnecessarily complex and expensive machining. Nor can they readily be disassembled in the field by the user for cleaning and service. They also make use of small, internal coil springs which are frequently subject to breaking or jamming with dirt or other foreign material. The Karge and Fox mechanism will allow the socket to simply fall off when the latch is unlocked.

Further U.S. Patents which are pertinent to this subject are U.S. Pat. No. 4,400,511-Nov. 6,1984 to Nickipuck; U.S. Pat. No. 4,502,365-Mar. 5, 1985 to Hacker; U.S. Pat. No. 4,537,100-Aug. 27, 1985 to Palm; U.S. Pat. No. 4,571,113-Feb. 18,1986 to Coren; U.S. Pat. No. 4,589,308-May 20, 1986 to Palm; U.S. Pat. No. 4,768,405-Sep. 6, 1988 to Nickipuck; U.S. Pat. No. 4,770,073-Sep. 13, 1988 to Palm; U.S. Pat. No. 4,848,196-Jul. 18, 1989 to Roberts; U.S. Pat. No. 4,938,107-Jul. 3, 1990 to Nickipuck; and U.S. Pat. No. 5,214,986-Jun. 1, 1993 to Roberts. These are all characterized by external operating sleeves located near the male end of the extension which subjects them to accidental unlocking of the socket; excessive small parts; difficult and expensive machining; and difficult or impossible field disassembly for service and cleaning. Finally, none of these are automatically actuated by the insertion of the turning wrench driving stud.

U.S. Pat. No. 5,289,745-Mar. 1, 1994 to Beardsley; U.S. Pat. No. 4,399,722-Aug. 23,1983 to Sardo; and U.S. Pat. No. 4,733,584-Mar. 29, 1988 to Karge improves on the aforementioned configurations, at least to the extent that they do lock the socket on the insertion of the driving stud. However, in the example of the Beardsley patent, the asymmetrical location of the bore and its differing diameters for the operating rod increases the cost of machining. Its reliance on a multiplicity of detent balls and small coil springs, which must be coil-bound to lock, decreases its reliability and increases the difficulty of service and cleaning. The Karge patent has the same deficiences and will also release the socket on removal of the driving stud. The Sardo patent has similar faults, but requires a specially designed turning wrench handle.

There is, evidently, room for considerable improvement in this field and the following summary of the present invention will will show how this may be accomplished.

SUMMARY OF THE INVENTION

Socket tool sets are available in drive sizes from miniature to large industrial sizes. Accordingly, a convenient and economical extension which positively locks a socket to its driven end will have a wide field of practical use. A comprehensive solution to these problems requires that it have no external controls which could accidentally be bumped to the unlocked position; that it be completely automatic in operation; that it be economically manufacturable with existing tool-making equipment; that it have few parts and require little expensive machining; and that cleaning and service can be accomplished by the user in the field. The following described construction constitutes a unique solution to all of these requirements.

This invention is minimally composed of three parts: the main shaft of the extension, the operating rod, and the locking lug. The main shaft is a continuous element with a standard drive and driven end to accommodate conventional sockets and conventional wrench driving elements. It has a continuous longitudinal hollow from end to end. The locking lug is fitted and retained in the driven end of the main shaft by a hole normal to shaft's longitudinal axis. This hole is reduced in size at one external side of the driven end to prevent the lug escaping. The operating rod is continuous from the drive end for the wrench driving element to nearly the driven end of the main shaft. It has one or more relatively narrow sections spaced appropriately along the length of the rod. These sections are of a size to permit the rod to slide axially in the main shaft's longitudinal hollow and they function as a fulcrum allowing clearance for spring-like deflection of the rod. The rod termination at the shaft's driven end has an enlargement immediately adjacent to a reduced section which the locking lug nests into when the operating rod is in the socket retained but not locked position. This reduced section then increases in size to a dimension which completely fills the space between the inside surface of the lug and the opposite surface of the continuous hollow in the main shaft. The operating rod is composed of a material which, when deflected by the locking lug, will produce a reaction force normal to the axis of the main shaft and against the locking lug or ball.

In operation, before the installation of a socket, the lug is nested in the matching reduced section of the operating rod. When the driving connection of a socket is mated with the driven end of the extension, the locking lug forces down the cantilevered reduced section end of the rod. This resistance retains the socket in place, but does not lock it against removal. When the driving element of a ratchet or other turning wrench handle is inserted in the drive end of the extension, the operating rod is translated axially so that the increasing dimension of the rod causes further resistance against the locking lug and deflects the cantilevered end farther in the direction of opposite side of the continuous shaft hollow. At this point, the cantilevered end of the rod just clears the opposite side of the shaft hollow and will not allow sufficient movement of the lug to release the socket. The socket is now locked firmly in position and cannot be removed. When the turning wrench handle is disengaged from the drive end of the extension, the longitudinal component of the deflection reaction automatically forces the operating rod back to the reduced section where the lug nests and prevents the socket from completely disengaging. This position permits the socket to be removed by hand and exchanged for another socket as required.

It is important to note that the operating rod deflection and its corresponding reaction perpendicular to the axis is that of a spring and makes the conventional use of a small and fragile coil spring bearing against a detent lug completely unnecessary.

BRIEF DESCRIPTION OF THE DRAWING

FIG. 1 is a longitudinal cross-section of an extension element according to the present invention as it appears in the retained but not locked condition.

FIG. 2 is a view very similar to FIG. 1 and illustrates the extension element as it appears in the locked condition.

DRAWING REFERENCE NUMERALS AND NOMENCLATURE

4 operating rod
6 main extension shaft
8 detent lug, usually but not necessarily a sphere
10 narrow enlarged section of operating rod, an annular ring if rod is cylindrical
12 turning handle of any configuration compatible with the wrench system
14 socket wrench used in the wrench system
16 locking enlargement of rod 4 tangent to reduced section 20. This may be an inclined straight line or for decreased friction, some mathematical curve, possibly a tractrix
18 end enlargement on rod 4 adjacent to reduced section 20
20 reduced section of rod 4 where detent lug nests when socket is retained but not locked
22 driven end of main shaft 6
24 drive end of main shaft 6

DESCRIPTION OF THE PREFERRED EMBODIMENT

Referring now to the drawing, FIGS. 1 and 2, the present invention will be seen to comprise a socket tool extension element consisting of a main shaft 6, an operating rod 4, and a detent lug 8. Shaft 6 will, in most cases, have the conventional drive and driven square drive stud and recess, but may be of other polygonal shapes or splined as in the case of certain heavy industrial socket tool sets. The shaft 6 may be of any desired extension length. Although it is usually of circular cross-section, other shapes may be used as needed by the application. Shaft 6 has a continuous void from the driven end 22 to the drive end 24 through which rod 4 translates on application of a driving element.

The operating rod 4 is a continuous element of a length appropriate to the desired length of the extension. The raised ribs 10 are a close but slidable fit in the void of shaft 6 and are integral with the reduced section of rod 4. Rod 4 has an enlargment 18 at the detent end to prevent it from slipping back past detent lug 8. Immediately adjacent to this enlargement is a reduced section 20 into which lug 8 nests. Tangent to the reduced section is an angular or curved enlargment 16. On application of the driving element 12, lug 8 forces this end of rod 4 towards the opposite side of the shaft void, thus generating a force normal to the axis of rod 4. This force between section 20 and lug 8 positively locks the socket in place. The rod may be, but is not necessarily of circular cross-section.

The lug 8 may be a simple sphere of material as required to suit the application. It is retained in the driven end 22 of the extension by a surface reduction in the size of its recess.

In operation then, one selects the desired size of socket wrench, snap-fits it to the driven end of the extension against the force on lug 8 exerted by the slightly deflected position of rod 4. This force retains but does not lock the socket. Then one applies the desired turning wrench handle which may be a ratchet, breaker-bar, power wrench, T-handle, speeder, or other device with the appropriate driving element. This action translates the operating rod 4 which positively locks the socket to the extension. To change sockets, one disengages the turning handle 12 which allows the axial component of the reaction of lug 8 against the incline of rod 4 to translate the rod to the position where the lug 8 nests in the reduced section 20 of the rod as shown in FIG. 1. Then the socket is manually removed and exchanged for one of the desired size. The operator then re-applies the turning handle 12 which locks the new socket in place.

SCOPE AND OTHER EMBODIMENTS

The above described configuration is merely an illustrative example of one embodiment of the present invention. Numerous other arrangements may be readily devised by those skilled in the art which will embody the principles of the invention and fall within the spirit and scope thereof. One example might be where these must be used in a particularly dirty environment is the addition of an elastomeric seal around the operating rod at the drive end of the extension. Additionally, certain existing ratchet handles have a small shaft extending from the driving stud as part of its socket locking mechanism. The end of the operating rod at the drive end of the extension can be recessed to accommodate this shaft which will allow the ratchet to be removed. Further, while the most usual material for this extension will be the steel customarily used for socket wrench appurtenances, it can be made of non-sparking, or non-magnetic metals or materials; or if extreme lightness is required, even advanced composite materials. One advantage of this construction is that it can be manufactured on existing manufacturing equipment using readily available standard tubing, thus eliminating the expensive boring of the continuous hole through the extension shaft. The detent/locking lug can be a simple standard bearing-ball. The operating rod can be mass-produced on properly set-up automatic rolling machines. The objectives of simplicity, ease of manufacture, positive locking of the socket, automatic in-use operation, and few parts are achieved by this invention.

Other embodiments of this invention may have an enlarged bore diameter at the driven end for greater flexibility in the design of the locking geometry. Especially in the case of short extensions, operating rods without the enlarged fulcrum portions could be a slidable fit in the continuous hole in the shaft. The aforementioned elastomeric seal would accommodate length variation in turning handle drive elements and would increase the longitudinal force component unlocking the socket as would a supplementary spring. The operating rod can be of multiple diameters as needed to control deflection and retaining force on the locking lug or ball.

We claim:

1. A socket locking extension for use with wrench handles which will automatically and positively lock a socket to a driven end of the extension upon connection of the wrench handle to a drive end of the extension, both ends having engagement surfaces, the extension comprising;

a main shaft having a continuous opening therethrough aligned with an axis of the shaft, a movable latch means projecting through a portion of the said engagement surfaces at the driven end and adapted to engage a retention means, a longitudinally movable, flexible rod in said continuous opening and projecting into the drive end of the shaft for contact with a drive element of the handle which moves the rod, producing a locking force, said rod having a suitable number of enlarged sections spaced along its length providing a slidable fit within the continuous opening, said sections functioning as fulcrums and providing clearance for deflection of said rod and reducing sliding friction of said rod, a latching end of said rod having a reduced section in which the retention means will nest, said latching end of said rod having an incline adjacent to the reduced section producing a longitudinal component of the locking force, biasing the rod towards the drive end, whereby upon insertion of the handle into the drive end, the rod is slid toward the driven end and caused to deflect thus forcing the retention means into a locking position and locking a socket in place on the driven end of the extension.

2. The extension of claim 1 comprising an elastomeric pad on the shaft at the drive end of the extension provide seal against dirt and contaminants;

said pad allowing the accommodation of different lengths of wrench drive elements.

* * * * *